United States Patent [19]

Block

[11] 4,334,620

[45] Jun. 15, 1982

[54] KEY STORAGE RACK

[75] Inventor: Mitchell L. Block, Highland Park, Ill.

[73] Assignee: Block and Company, Inc., Wheeling, Ill.

[21] Appl. No.: 191,852

[22] Filed: Sep. 29, 1980

[51] Int. Cl.[3] ..... A47F 7/00

[52] U.S. Cl. ..... 211/13; 40/19.5; 312/234.4

[58] Field of Search ..... 211/41, 13, 162, 10, 211/11; 40/19.5, 2 A, 330; 312/183, 234.2, 234.4, 234.5

[56] References Cited

U.S. PATENT DOCUMENTS

| | | | |
|---|---|---|---|
| 1,742,542 | 1/1930 | Howell | 211/13 X |
| 1,770,327 | 7/1930 | Thayer | 211/13 X |
| 3,227,504 | 1/1966 | Dunham | 312/234.4 |
| 4,199,067 | 4/1980 | Block | 40/2 A X |

*Primary Examiner*—Roy D. Frazier
*Assistant Examiner*—Robert W. Gibson, Jr.
*Attorney, Agent, or Firm*—Norman Lettvin

[57] ABSTRACT

A key control system is provided by a frame that includes multiple slide channels for vertical movement therein of generally planar key rack members. Each key rack member is articulated to provide an upper key-holding section for selectively angled display of keys thereon. The key rack member may be stored away in a lowered position in the frame, or be moved to the display position, or be selectively removed from the frame.

6 Claims, 9 Drawing Figures

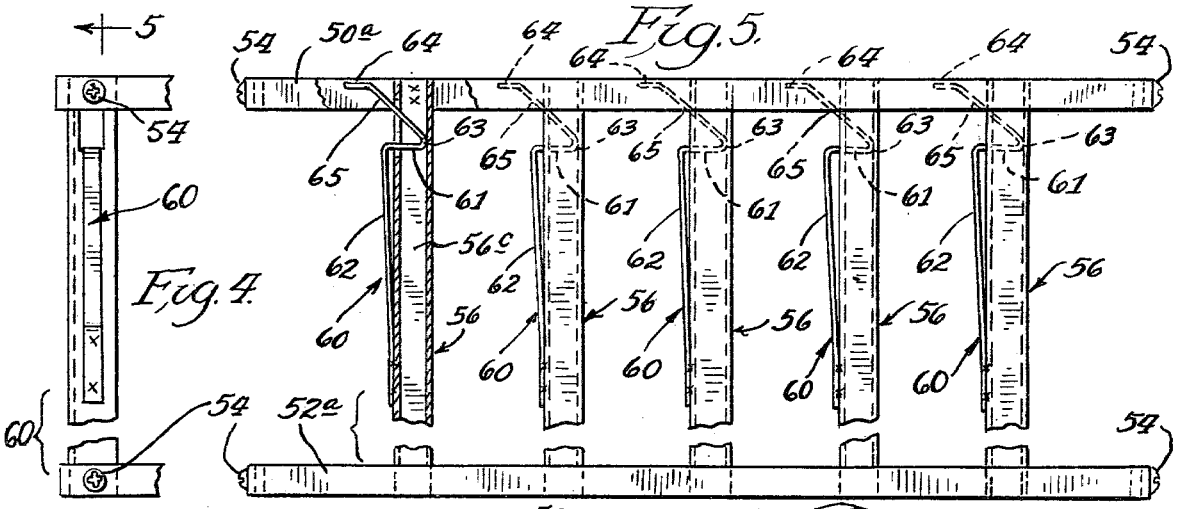
5
54
60
Fig. 4.
Fig. 5.
50a
64
63
65
61
62
56c
56
52a
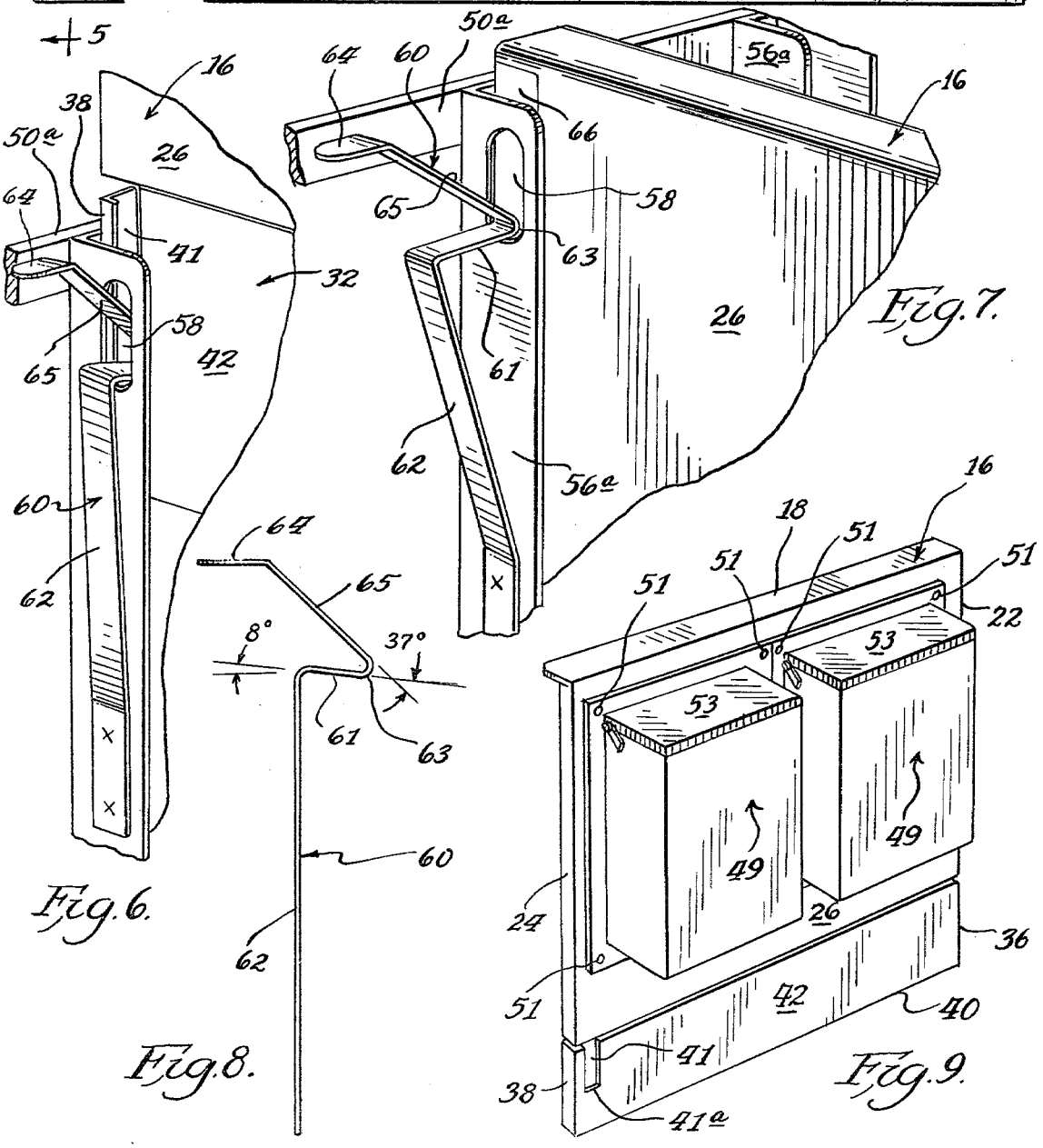
5
16
38
50a
26
64
41
32
58
42
65
60
62
Fig. 6.
Fig. 7.
66
56a
8°
37°
61
63
Fig. 8.
18
51
22
53
49
24
36
42
40
41
38
41a
Fig. 9.

KEY STORAGE RACK

FIELD OF THE INVENTION

This invention relates generally to key control systems and more particularly to a key control system for conveniently organizing, and accessibly storing keys in a controlled area such as a desk drawer.

BACKGROUND OF THE INVENTION

Efficient key control is important to the successful operation of many businesses. It is desirable that original and duplicate keys for doors, machinery, cabinetry and other apparatus be safely stored in and dispensed from a common storage point under the direct control of a limited group of supervisory personnel.

U.S Pat. No. 4,199,067, commonly assigned herewith, provides a key control system wherein a key rack is attached to the following block of a desk drawer or filing cabinet to conveniently arrange and securely store a plurality of office related keys in an orderly array. Since only one key rack can be attached to the following block of a desk or cabinet and since the key rack can manage only a specific number of keys, only a finite number of keys can be stored in a given drawer or cabinet.

It is therefore one object of the present invention to provide a key control system which includes a key rack support frame adapted to support a plurality of key racks so as to accommodate a much greater number of keys.

One known desk-type key control system, adapted to handle a great number of office keys, includes an open-topped tray, sized and shaped to fit within a desk or file cabinet drawer, for loosely receiving thereinto a plurality of separate panels having rows of keys attached thereto, with each panel stacked or leaning against an adjacent panel. Such a system lacks definitive organization, permits keys to become dislocated due to manipulation of panels or relatively small forces applied to panels or tray, and requires lost time in refiling or reinstating loose keys in their correct sequence onto the individual panels.

It is yet another object of the present invention to provide a key control system which includes a key rack support frame having key-rack-receiving channels for securing a plurality of key racks in fixed, spaced, relationship to one another and which is sized and shaped to fit within a desk and file cabinet drawer.

It is a still further object of the present invention to provide a key control system wherein key racks, spacedly received in the key rack support frame channels, each may be raised, as desired, within the channels and pivoted to a self-locking, angled, easy-to-read position without disturbing adjacent key racks.

It is still another object of the present invention to provide a desk-drawer-sized key control system, for storing key tags, out-key cards and other key-related paraphernalia, said system including pouched panels adapted to be received within the channels of the key rack support frame.

It is yet a further object of the present invention to provide a key control system wherein the key racks are received in key rack support frame channels which channels and racks cooperate to prevent unintentional removal of the racks.

These and other objects and advantages of the invention will become clear from the following description of the preferred embodiments.

BRIEF DESCRIPTION OF THE INVENTION

A key control system is provided by an apparatus that may be stored in a lockable desk drawer. The system includes a frame with a plurality of slide channel slots defined thereon, each for receiving a single key rack. The key rack is a planar type member when stored away in the channel slot of the frame, but the rack may be moved vertically relative to the frame, either to a display position, or to be removed from the frame. In the display position, the upper portion of the key rack is articulated relative to the lower portion of the rack so that said upper portion with keys thereon is inclined for viewing, the lower portion of the rack remaining in the slide channel. The inclined upper portion of the key rack cooperates with the frame to hold the key rack in its display position, a safety latch may be provided to prevent the key rack from being removed from the slide channel, but a manual control of the safety latch permits release of the panel when desired.

In a modified form, the upper panel of the key rack is provided with openable storage pouches.

BRIEF DESCRIPTION OF THE DRAWINGS

FIG. 4 is a fragmentary front plan view, showing the cantilevered spring-type safety latch mounted on a channel member of the frame;

FIG. 5 is a cross-sectional view taken along line 5—5 of FIG. 4, illustrating a plurality of the spring-biased-type safety latches extending through apertures in the channel members;

FIG. 6 is an enlarged fragmentary perspective view of the construction illustrated in FIGS. 4 and 5 showing the key rack in elevated position;

FIG. 7 is an enlarged fragmentary perspective view of the construction illustrated in FIGS. 4 and 5, showing the key rack in lowered, or stored away, position;

FIG. 8 is a side elevational view of the spring-type safety latch shown in FIGS. 4–7; and FIG. 9 is a perspective view of a modified rack which has secured to one end face therefore a pair of zippered pouches.

DETAILED DESCRIPTION OF THE DRAWINGS

Figure 1:
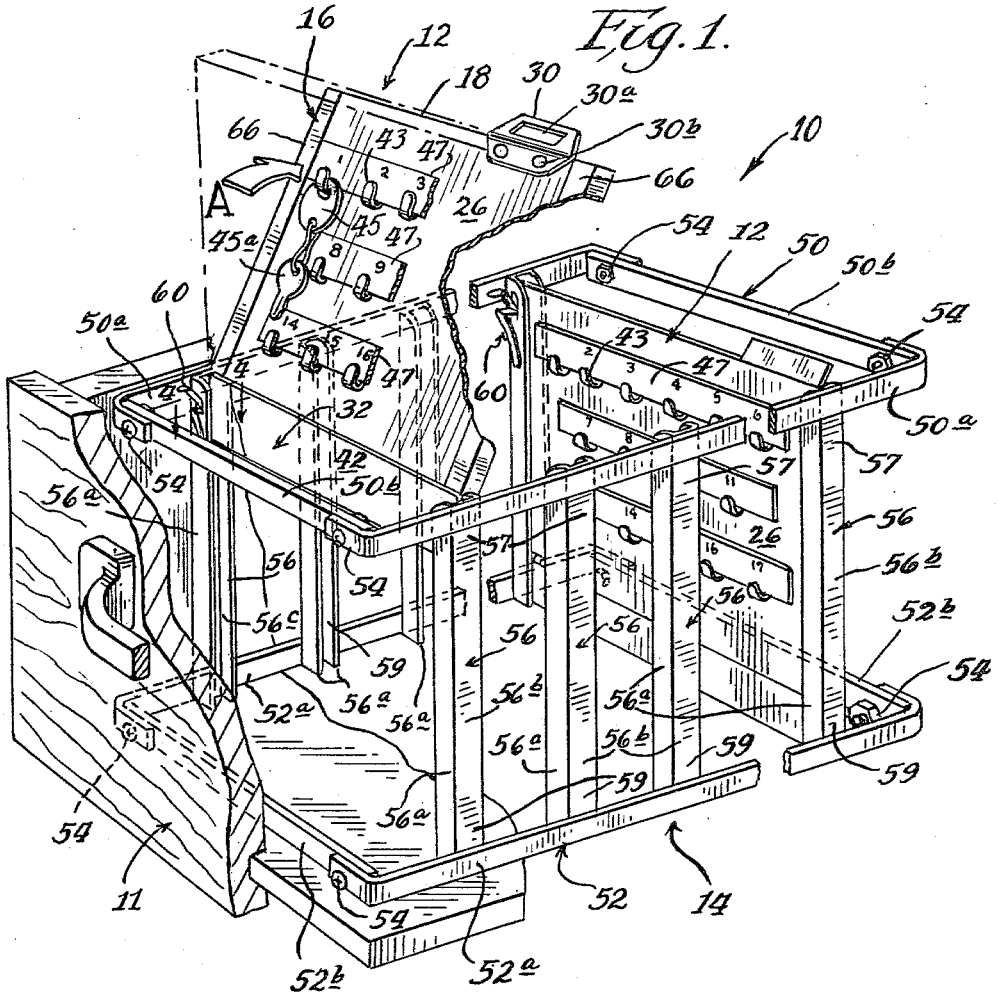
FIG. 1 is a perspective view of the key control system of the present invention positioned within a desk drawer which is partially broken away to reveal a pair of key racks, supported by a frame, and with one key rack being pivoted to an angular display position, and the other key rack in its stored away position.

Referring now to the drawings and particularly to FIG. 1, the combination key rack and key rack support frame of the present invention 10 is illustrated positioned within a desk or file cabinet drawer 11. The combination key rack and support frame 10 comprises a key rack generally designated as 12 and a support frame generally designated as 14.

Figure 2:
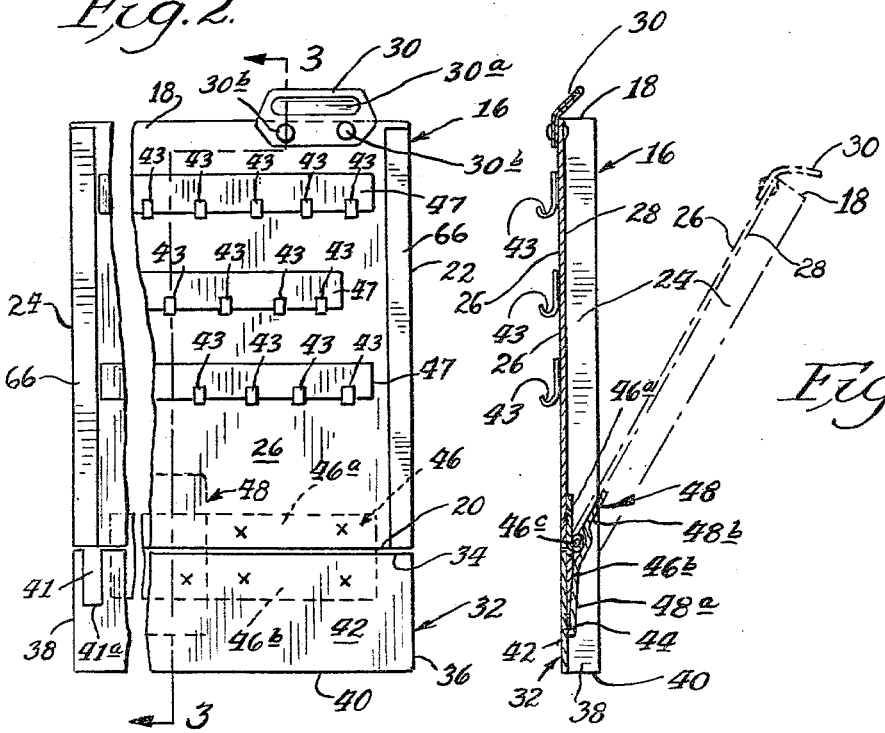
FIG. 2 is a fragmentary front elevational view of the key rack of the present invention.
Figure 3:
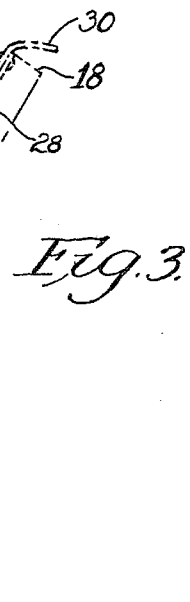
FIG. 3 is a cross-sectional view taken along line 3—3 of FIG. 2, illustrating in solid lines, the key rack in a non-pivoted position for storage, and illustrating, in phantom lines, the upper plate portion of the rack pivoted to an angular display position.

The key rack 12, as best shown in FIGS. 1–3, includes an upper plate 16 preferably fabricated of 20-gauge steel and having a top edge 18, a bottom edge 20, parallel side edges 22 and 24, and opposed, generally flat, planar end faces 26 and 28. In the preferred embodiment, the side edges 22 and 24 and the top edge 18 of the upper plate 16, are flanged. An indexing tab 30 is adapted to receive in the window portion 30*a* thereof, a paper identifying the nature of the keys stored on the rack 12. The tab 30 is riveted, as at 30*b*, to face 26 of the upper plate 16 adjacent the top edge 18.

A lower plate 32 preferably formed of 18-gauge steel and having a top edge 34, parallel side edges 36 and 38, a bottom edge 40 and generally flat, planar, opposed end faces 42 and 44 is pivotably connected to the upper plate 16. To effect the rotational connection, one side 46*a* of a conventional butt-type hinge 46 may be spot welded, or otherwise suitably secured, adjacent the bottom edge 20 of the rear face 28 of the upper plate 16, and the other side 46*b* of the butt-type hinge 46 may be secured in a like manner adjacent the top edge 34 of the rear face 44 of the lower plate 32. An elongated dowel 46*c* connects hinge elements 46*a* and 46*b* and permits pivoting thereabout of the top plate 16 relative to the lower plate 32. The knuckle or pivot point of the hinge 46 extends rearwardly of the hinge plates 46*a* and 46*b* so that the upper plate is prevented from swinging forward; i.e., in direction opposite to the direction of arrow A in FIG. 1. More specifically, by positioning the knuckle rearwardly of the hinge plates 46*a* and 46*b*, forward articulation of the upper plate 16 relative to the lower plate 32 is prevented by the abutment of the top edge 34 of the lower plate 32 and the bottom edge 20 of the upper plate 16.

The rear face 44 of the lower plate 32 has secured thereto a forked stop 48, best illustrated in FIG. 3. The stop 48 is an angled, two-pronged member, the prongs of the stop 48 defining an obtuse angle therebetween. The lower prong 48*a* of the stop 48 is a planar member which is secured to the lower plate 32 adjacent the hinge 46. The upper prong 48*b* is a generally planar member which curves around and extends beyond the pivot point 46*c* of the hinge 46. The stop 48 allows the upper plate 16 to be pivoted or angulated relative to the lower plate 32 in a clockwise direction, i.e., in the direction of arrow A, until the rear face 28 of the upper plate 16 abuts and rests against the upper prong 48*b*.

As most clearly shown in FIGS. 2, 5, 6 and 9, an elongated latch projection-receiving slot 41 is formed in the face 42 of the lower plate 32 adjacent the side edge 38. The slot 41 extends downwardly from the top edge 34 of the lower plate 32 and includes an abutment wall 41*a*. Although only one side edge 38 of the lower plate 32 is slotted, the other side edge 36 may also be slotted without departing from the spirit and scope of the invention.

A plurality of hooks 43 are spacedly secured to the end face 26 of the upper plate 16 for receiving thereon apertured key holders 45 having keys 45*a* attached thereto. In a preferred embodiment, relatively thin, elongated strips of a rigid, but deformable material 47 are adhesively secured to the end face 26. The elongated strips include a plurality of depending fingers which are bent upwardly to form the spaced, key-receiving and storing hooks 43. It should be noted that the horizontal spacing between the hooks 43 and the vertical spacing between the strips 47 are dependent upon the shape and size of the keys 45*a* to be stored and, therefore, the vertical and horizontal spacing may be varied as required.

One or more enclosed storage pockets 48, see FIG. 9, may be secured by riveting as at 51, or by other commonly used attachment means, to the end face 26 of the upper plate 16 of a key rack 12. The pockets 49 are flexible, rectangularly shaped pouches having openable zippered tops 53. Although it is preferred that two pockets 49 may be secured to the plate 16 so as to substantially cover the face 26 of the plate 16, a single pocket of a sufficient width to cover the face 26 may also be used. The pockets 49 are adapted to store key tags, out-key cards, returned out-key tags and other related key indexing and tag-marking paraphernalia.

The key rack support frame 14 includes a pair of rigid, vertically spaced, generally horizontally disposed, generaly rectangularly-shaped upper and lower casements 50 and 52 interconnected by at least one pair of slide channels, as will be fully described hereinafter. Each of the upper and lower casements 50 and 52 is formed by a pair of opposed, parallel side members 50*a* and 52*a*, and a pair of opposed parallel end members 50*b* and 52*b*. The distal ends of the side members 50*a* and 52*a* and the distal ends of the end members 50*b* and 52*b* are secured as by nut and bolt connections such as 54, so as to form the rigid, rectangular shape of the casements.

A plurality of elongated slide channel members 56 are arranged in a plane transverse to the upper and lower casements, 50 and 52 respectively. Each of the channel members 56 is of U-shaped cross-sectional configuration and includes oppositely disposed ends 57 and 59 which are secured to the side members 50*a* and 52*a* of the upper and lower casements 50 and 52. One distal end 57 of each of the channel members 56 is spot welded or otherwise secured to the side members 50*a* of the upper casement 50 and the other distal end 59 of each of the channel members 56 is secured to the side members 52*a* of the lower casement 52. The channel members 56 thereby position the upper casement 50 and the lower casement 52 in said vertically-spaced, parallel, horizontal planes.

The channel members 56 are preferably secured to the casements in pairs. A pair of channel members 56 is defined as one channel member 56, having the first distal end 57 secured to one of the upper casement side members 50*a*, and the other distal end 59 secured to one of the lower casement side members 52*a*, and a second channel member 56 having the first distal end 57 secured to the upper casement side member 50*a* opposite the upper casement side member to which the first end of the first channel member is attached and the other distal end 59 secured to the lower casement side member 52*a*, opposite the lower casement side member to which the other end of the first channel member is attached. In the preferred embodiment, all pairs of channel members 56 lie in a plane parallel to the plane formed by the adjacent end members 50*b* and 52*b* of the upper end lower casements 50 and 52, i.e., in a plane transverse to the plane of the upper and lower casements.

The U-shaped cross-sectional configuration of each of the channel members 56 is defined by two opposed elongated, parallel legs 56*a* joined by a bight portion 56*b*. The interior area between the legs 56*a* forms a slide channel or track 56*c* for slidably receiving therein the side edges 22 and 24 of the upper plate 16 and the side edges 36 and 38 of the lower plate 32 of the rack 12. The channel members 56 are secured to the upper and lower casements 50 and 52 such that the tracks 56c formed between opposed legs 56a face inwardly, or open toward one another, for receiving said opposed side edges of the rack 16.

As best seen in FIGS. 4–7, at least one of each pair of channel members 56 may be provided with a safety latch 60 for preventing unintentional removal of the key rack 12, but which latch 60 may be manually moved to release the rack 12 from the channel member 56. The safety latch 60 includes a leaf spring 62 cantilevered at one end thereof to one leg 56a of the channel member 56 and aligned at the other end thereof with an aperture or slot 58 in the leg 56a. The spring 62 has the upper end thereof deformed to form a rearwardly extending, generally horizontal (8° to the horizontal) surface 61; an upwardly and forwardly extending cam surface 65; and a forwardly extending, generally horizontal finger depressing surface 64. With the leaf spring 62 cantilevered to the channel member leg 56a, a portion of the horizontal surface 61 and the cam surface 65, hereinafter spring projection 63, are biased to extend through the aperture 58 and into the track 56c formed between the legs 56a of the channel member 56. With the key rack 12 disposed within the track 56c, removal of the rack 12 is prevented when the spring projection: passes through channel member aperture 58; is biased to travel along the lateral edge of the front face 26 of the upper panel 16; is received within the lower panel slot 41 as the slot 41 is aligned with the aperture 58; and contacts the slot abutment wall 41a. Because the spring projection 63 is constantly in friction contact with the upper plate 16, strips of a tape, such as Permacel polyethylyne tape, are affixed, as at 66, to the lateral edges of the front face 26 of the upper plate 16.

The finger grip 64 can be depressed to move the spring projection 63 clear of the track 56c formed between the channel member legs 56c so that the rack 12 can be withdrawn from the channel. The angled, cam surface 65 of the leaf spring 62 cooperates with the lower edge 40 of the lower plate 32 and the lower edge of the upper plate 16 to cam the spring outwardly, against the bias of spring 62, so that the spring projection 63 is moved clear of the track 56c, thereby permitting the rack 12 to be lowered into the track 56c. However, because of the angular disposition of the horizontal surface 61 of the spring 62 (relative to the path of travel of the rack 12 when the rack is disposed within the tracks 56c of the slide channels 56), the spring 62 is not cammed outwardly by an upward force imparted to the horizontal surface 61 by the abutment wall 41a of the slot 41 in the lower plate 32 as the rack 12 is slid upwardly. The angled cam surface 65 and the horizontal surface 61 allow the user, with only one hand, to: (1) withdraw the key rack 16 to a self-locking, angled display position (shown in phantom lines in FIG. 3), and (2) return the rack 16 to a vertical storage position (shown in solid lines in FIG. 3).

The number of pairs of channel members 56 adapted to be secured to the upper and lower casements 50 and 52 is dependent upon the length of the drawer or other cabinetry in which the key rack and support frame 12 will be stored and the number of keys to be stored by said rack 16. The height of the channel members 56 is likewise dependent upon the height dimension of the drawer or other storage cabinetry and the number of horizontal rows of key-receiving hooks required. The key rack and support frame are preferably formed from rigid metal materials; however, other materials such as plastic or wood could be employed without departing from the spirit and scope of the invention. The means of securing the frame elements together has been described as either nuts and bolts or spot welds; however, any other conventional type of fastening means may be substituted.

OPERATION

In use, a key rack support frame 14 is placed within a drawer or some other suitable storage cabinet. The length dimension of the support frame 14 is selected to provide for the inclusion of a sufficient number of pairs of channel members 56 to provide storage space for the quantity of racks 12 required to store all of the keys 45a. The keys 45a, mounted on identifying tags 45, are slipped over the hooks 43 secured to the front end face 26 of the upper plate 16 of each rack 12. To facilitate retrieval, it is desirable, prior to placing the rack in the frame, to: (1) arrange keys for similar types of locks on the same rack 12, and (2) apply a marker or tag identifying the key types stored on a particular rack to the angled tab 30 riveted to the top edge 18 of the upper plate 16.

Each rack 12 with the keys 45a hooked thereon and the upper and lower plates angulated to lie in a generally vertical plane, may then be aligned with and received between the tracks 56c formed by a pair of oppositely disposed, aligned channel members 56. When it becomes necessary to retrieve a key 45a from storage, reference to the angled identification tab 30 enables the user to quickly locate the rack 12 on which a particular key 45a is stored. The rack 12, upon which the particular key 45a is stored, is grasped and withdrawn by sliding the rack 12 upwardly. The spring projection 63 normally is biased to abut the laterally taped edges of the front face 26 of the upper plate 16 as long as any portion of the front face 26 is aligned with the aperture 58 in channel member leg 56c. However, as the rack 12 is slid up the channel member, the spring projection 63 is urged by the bias of cantilevered leaf spring 62 through the aperture 58 in the channel member leg 56a and into the slot 41 in the lower plate 32. If the user continues to slide the rack 12 upwardly, the spring projection 63 will contact the abutment wall 41a of the slotted lower plate 32 to halt further upward movement of the rack 12. At this point, the upper plate 16 rests above the upper distal ends 57 of channel members 56 and above the plane of the upper casement 50, and is therefore free to pivot, in a clockwise direction, about the hinge 46. Once the upper plate 16 is pivoted in a clockwise direction (see arrow A in FIG. 1), the panel will remain in the angled display position because: (1) the bottom edge 20 of the upper plate 16 rests against the upper ends 57 of the channel members 56, and (2) the rear end face 28 of the upper plate 16 contacts the angled prong 48a of the stop 48.

If it becomes necessary to remove the rack 12 from the channels of the support frame 14, the horizontal finger section 64 of the cantilevered leaf spring 62 is depressed to move the spring projection 63 from within the track 56c in which the rack 12 reciprocates. With the finger section 64 depressed, further upward force on the rack 12 withdraws same from the support frame 14. Other racks 12 may be selectively removed from their associated channel members 56 in a similar manner.

While one form of the invention has been described, it will be understood that the invention may be utilized in other forms and environments so that the purpose of the dependent claims is to cover all such forms and devices not disclosed but which illustrate the invention disclosed herein.

What is claimed and desired to be secured by Letters Patent of the United States is:

1. A key control system for storing and indexing keys which includes a key rack support frame and at least one key rack for selective movable positioning in the frame or for removal from the frame, said system comprising, in combination:

a support frame including vertically spaced, generally rectangularly shaped, upper and lower casements, interconnected by at least a pair of elongated, key rack-receiving slide channel means arranged in a plane transverse to the upper and lower casements;

and a key rack adapted to be slidably disposed in the pair of slide channels and comprising a generally rectangularly shaped upper plate having opposed, planar end faces; a generally rectangularly shaped lower plate having opposed, planar end faces; said upper plate being pivotably connected to said lower plate; and a plurality of key-supporting hooks secured to one face of said upper plate;

said upper plate of the key rack being pivotable relative to the lower plate, when the upper plate is withdrawn to a position above the upper ends of the channel means, to a position where the upper panel will engage means on the key rack support frame for holding the key rack in an elevated position which is inclined relative to the plane of the channels.

2. A combination as in claim 1, wherein the holding means is defined by the upper ends of at least one of the channel means which engage the lower panel to hold the upper panel of the key rack in an elevated, inclined position.

3. A combination as in claim 1, wherein stop means for preventing pivoting of said upper plate beyond an angular display position is secured to the face of the lower plate opposite the hooked face of the upper plate, whereby said upper plate of said rack may be raised above the upper ends of the channel means and pivoted to dispose the hooked, key holding face of said rack in the display position.

4. A combination as in claim 1, wherein said lower plate includes an elongated slot having an abutment wall, said slot adapted to be slidably received within said channel means; a spring-biased, inwardly extending projection secured to said channel means, said projection normally spring biased to extend into said slot in said lower plate when said key rack is received within and raised above the upper ends of said channel means, whereby said projection, when in its normal biased position, operates to prevent removal of said lower plate of said rack from said channel means.

5. A combination as in claim 1, wherein the upper plate of each key rack includes a tab adapted to be marked with indicia indicative of the class of keys stored on said rack.

6. A combination as in claim 1, wherein one end face of an upper plate having secured thereto zippered pouch means for storing therein key holders, key identifying tags and other key-related paraphernalia.

* * * * *